United States Patent [19]

Lewis

[11] Patent Number: 5,028,030

[45] Date of Patent: Jul. 2, 1991

[54] PICTURE HANGER AND METHOD THEREFOR

[76] Inventor: Charles J. R. Lewis, 7019 Via de Los Ninos, Scottsdale, Ariz. 85258

[21] Appl. No.: 503,766

[22] Filed: Apr. 3, 1990

[51] Int. Cl.[5] ..... A47G 1/16

[52] U.S. Cl. ..... 248/493; 248/218.2

[58] Field of Search ..... 248/489, 216.1, 217.1, 248/218.2, 218.3, 493

[56] References Cited

U.S. PATENT DOCUMENTS

| | | | |
|---|---|---|---|
| 1,210,610 | 1/1917 | Dehn | 248/489 |
| 1,445,372 | 2/1923 | Wagner | 248/217.1 |
| 2,789,783 | 4/1957 | Jones | 248/218.2 |
| 3,219,302 | 11/1965 | Smith | 248/311.2 X |
| 3,268,195 | 8/1966 | Hoffman | 248/489 |
| 3,289,992 | 12/1966 | Brooks . | |
| 3,312,442 | 4/1967 | Moeller | 248/216.1 |
| 3,430,301 | 3/1969 | Venus | 248/489 |
| 4,509,713 | 4/1985 | Hogg | 248/218.3 X |
| 4,619,430 | 10/1986 | Hogg | 248/216.1 X |
| 4,664,350 | 5/1987 | Dodds et al. | 248/218.2 X |

FOREIGN PATENT DOCUMENTS 2811971 9/1979 Fed. Rep. of Germany ... 248/216.1

*Primary Examiner*—Gary L. Smith
*Assistant Examiner*—Michael J. Milano
*Attorney, Agent, or Firm*—Harry M. Weiss; Antonio R. Durando

[57] ABSTRACT

This invention relates to a wall hanger that can be used to hang pictures and the like from a wall. The wall hanger is single, continuous wire member having a hook section, a linear section adjacent to the hook section and a curved section adjacent to the linear section. The linear section is designed to be longer than the thickness of the wall, thereby allowing the wall hanger to be used with pre-existing holes having diameters up to about four times the diameter of the wire member. The shape and resiliency of the wire member allow it to automatically lock into position when completely inserted in the wall. The wall has a blunt tail end which does not damage the back surface of the wall.

5 Claims, 1 Drawing Sheet

PICTURE HANGER AND METHOD THEREFOR

BACKGROUND OF THE INVENTION

1. Field of Invention

This invention relates generally to hangers, hooks and methods therefor for hanging a picture on a wall and more particularly, to an improved picture hanger and method therefor, that can be used with existing holes of varying sizes and that locks into position when inserted in the existing hole.

2. Description of the Prior Art

A review of the prior art reveals many different types of hangers and hooks which can be used to hang a picture on a wall.

Hogg, U.S. Pat. No. 4,509,713 discloses a locking wall hanger having a pointed end. This pointed end is designed to create the hole in the wall as the hanger is inserted therethrough. Thus, this hanger cannot be used in existing holes having a diameter greater than the diameter of the hanger.

The hanger of the subject invention can be used with pre-existing holes having diameters up to for example, at least four times the diameter of the hanger. Also, the subject invention does not have a pointed end, like Hogg, which can damage the backside of the wall. The differences in shape and structure between the subject invention and Hogg can be seen by comparing FIG. 1 of the drawings, which illustrates the subject invention, and FIG. 6 which illustrates a wall hanger sold under the Hogg patent.

Smith, U.S. Pat. No. 3,219,302 discloses another wall hanger which has a pointed tip. This wall hanger is also designed to create the hole as the device is inserted therethrough. However, the shape of this hanger makes it difficult to insert in the wall and requires that the user push perpendicularly on the device in combination with a reciprocal twisting motion, (see column 2, lines 38–43 of Smith). This hanger also has a horizontal, medial portion which must be longer than the thickness of the wall. Thus, this device cannot compensate for varying wall thickness. Also, the only way from preventing the hanger from rotating in its hole is by placing a load on its hook end.

The subject invention does not have a pointed end and is easily inserted into the wall because it can be used with holes having diameters greater than the diameter of the hanger itself. Also, due to its shape and construction, the subject invention automatically lock into position when inserted in the wall and does not require a load on the hook to keep it in place.

Jones U.S. Pat. No. 241,991 discloses a hook that like Smith U.S. Pat. No. 3,219,302 only locks in place when a load is placed on its hook and also, cannot compensate for varying wall thicknesses.

Jones U.S. Pat. No. 2,789,783 discloses a hanger that has a sharpened point so as to create a hole when being inserted. Like Hogg this hook can only be used in holes having diameters substantially equal to the diameter of the hanger and cannot be used with pre-existing holes.

Additional wall hanger designs are disclosed in Martin, U.S. Pat. No. 4,325,528, Mitchell U.S. Pat. No. 3,547,389, Brooks, U.S. Pat. No. 3,289,992. Schoor et al., U.S. Pat. No. 2,483,114, Wagner U.S. Pat. No. 1,445,372 and Dehn U.S. Pat. No. 1,039,367. These patents disclose wall hangers and the like significantly different from the subject invention.

Thus, there is a need for a wall hanger that can be used with pre-existing holes with diameters greater than the diameter of the wall hanger; that are easy to insert; that do not have a pointed end; and that lock into position without a load being disposed thereon.

SUMMARY OF THE INVENTION

An object of the subject invention is to provide a wall hanger and method therefor that can be used in pre-existing holes with diameters greater than the diameters of the wall hanger.

Another object of the subject invention is to provide a wall hanger therefor that locks into position upon being inserted in a pre-existing hole without a load disposed thereon.

Yet another object of the subject invention is to provide a wall hanger and method therefor that has a blunt contact point between the wall hanger and the backside of a wall.

These and other objects, features and advantages of the present invention, as well as details of the preferred embodiment thereof, will be more fully understood from the following description and drawing.

DESCRIPTION OF THE PREFERRED EMBODIMENT

Figure 1:
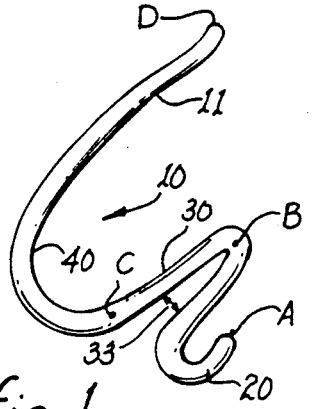
FIG. 1 is a side view of a picture hanger of the subject invention.
Figure 2:
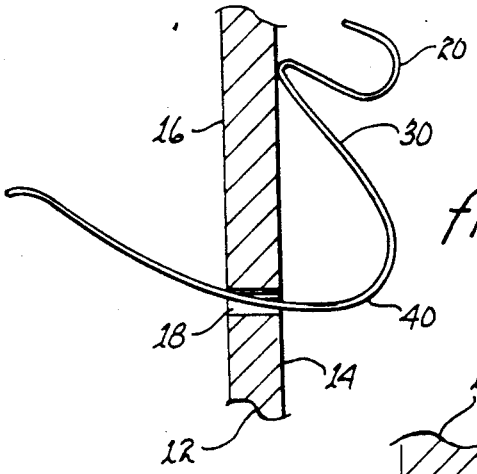
FIG. 2 shows the hanger of FIG. 1 being inserted in a wall.

Referring to the drawings, a wall hanger 10 is disclosed. In the preferred embodiment, the wall hanger 10 is a single, continuous, metal wire member 11 formed into the shape illustrated in FIGS. 1–3. The diameter of the wire member 11 is approximately in the range of from about 1/32 to 3/32 inches with an optimum diameter of about 1/16 inch. This thickness makes the wire member 11 sufficiently resilient so that it will spring back to its original shape after being stretched. It also enables the wire member 11 to withstand many cycles of stretching and contracting without breaking or becoming permanently deformed.

The wall hanger 10 is comprised of three sections; a hook section 20 extending from point A to point B, a linear portion 30 extending from point B to point C, a curved section 40 extending from point C to point D. As illustrated in the drawings, the part between points A and C defines a substantially "S" shaped configuration. The use of capital letters, in the specification and drawings, to indicate points on the wall hanger 10 is for illustration purposes only and is not intended to limit the scope of the subject invention in any manner.

Figure 3:
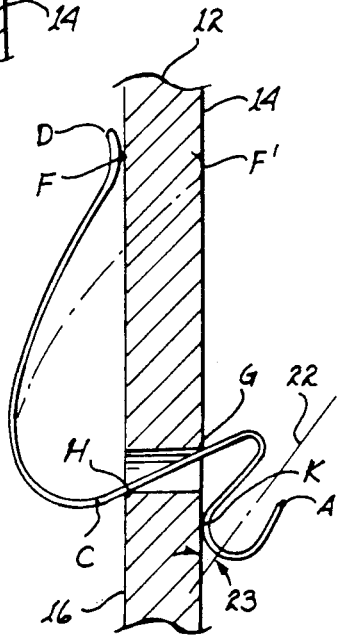
FIG. 3 shows the hanger of FIG. 1 inserted and locked into a wall.

FIG. 3 shows the wall hanger 10 inserted through a wall 12 and locked in position. The wall 12 has a front surface 14, a back surface 16, and a pre-existing hole 18 extending from the front surface 14 through to the back surface 16.

In the hook section 20, the wire member has a substantially parabolic shape with the open end of the parabola facing away from the wall 12. An axis 22 passing through the center of the hook portion 20 is positioned at an acute angle 23 from the front surface 14. Preferably, the angle 23 is about 15 degrees to about 45 degrees.

After exiting the hook section 20 the wire member 11 bends back towards the direction of the wall 12 creating an acute angle 33. Preferably, the acute angle 33 is between 15 degrees to about 45 degrees. The acute angle 33 need not be equal to the acute angle 23, but in the preferred embodiment the two angles are fairly close to each other.

Adjacent to the hook section 20 is the linear portion 30 in which the wire member 11 is linear. Because the length of the linear portion 30 is greater than the thickness of the wall 12, the linear portion 30 can be inserted through the hole 18 at an acute angle relative to the front surface 14, thereby contacting the surface of the hole 18 at only two locations G and H. The location G is the top of the hole 18 at the front surface 14 and the location H is the bottom of the hole 18 at the back surface 16. This two contact point configuration allows the wall hanger 10 to work in holes having diameters greater than the diameter of the wire member 11. In the preferred embodiment, the length of the linear portion 30 ranges from about ½ inch to about 3/2 inch so that the wall hanger can be used with conventional drywall having a thickness ranging from about ¼ inch to about ¾ inch. With these dimensions, the wall hanger 10 can be used in pre-existing holes 18 having diameters up to about ¼ inch. As one skilled in the art would know, the principle of the design of the wall hanger 10 would work effectively over a wide range of dimensions and is not limited to the dimensions recited previously. Also, the portion of the linear portion 30 that extends in front of the front surface 14 can also be used for mounting a picture or other such device.

Adjacent to the linear portion 30 is the curved section 40 in which the wire member 11 gradually curves towards the back surface 16 until point F is reached. At point F, the wire member 11 abuts the back surface 16. After point F, the wire member bends away from the back surface 16 for a very short distance, thereby assuring that point F is rounded and not sharp. This rounded end portion greatly enhances insertion and removal of the wire member 11 from the opening 18.

In operation, as the wall hanger 10 is inserted through the pre-existing hole 18, the point F comes in contact with the back surface 16 causing the curved portion 40 to deflect outward away from the back surface 16. In FIG. 3, the point F prime at the end of a dashed line shows the normal position of the curved section 40 before deflection. As the curved section 40 deflects, angle 33 is pulled apart. Thus, in the locked position, due to the shape and resiliency of the wire member 11, points F and G are drawn to each other and point K, where the hook section 20 abuts the front surface 14, is drawn to point G but is prevented from moving by the front surface 14. Therefore, points F, G, H and K are pressure points that permit the wire member 11 to be firmly and securely positioned on the wall. Accordingly, the diameter of the hole 18 and the thickness of the wall controls how much the wire member 11 will distort.

Figure 4A:
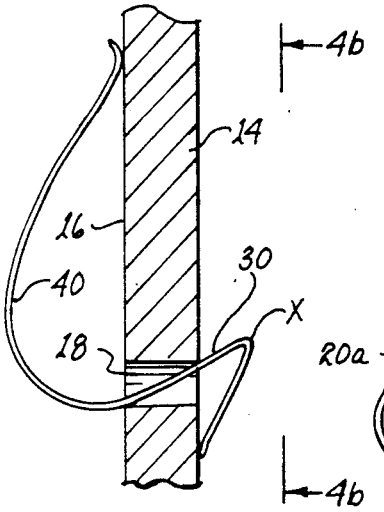
FIG. 4*a* is a side view of an alternative embodiment of the hanger of FIG. 1.
Figure 4B:
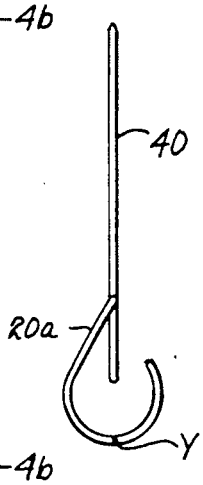
FIG. 4*b* is a front view of the alternative embodiment of FIG. 4*a*.

FIGS. 4*a* and 4*b* illustrate one alternative embodiment which is essentially the same as the preferred embodiment except the hook section 20*a* has been rotated ninety degrees from its position in the preferred embodiment so that it is now parallel with the front surface 14. A picture or the like can be hung at either point X or point Y.

Figure 5A:
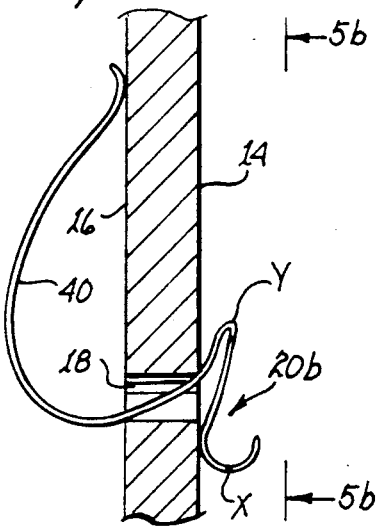
FIG. 5*a* is a side view of a second, alternative embodiment of the hanger of FIG. 1.
Figure 5B:
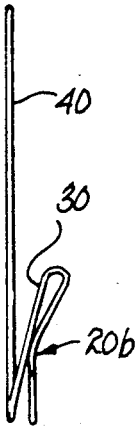
FIG. 5*b* is a front view of the alternative embodiment of FIG. 5*a*.
Figure 6:
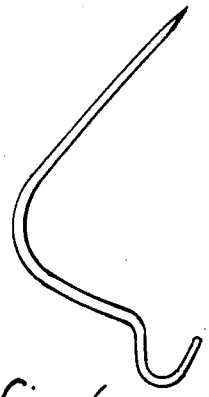
fig. 6 PRIOR ART
FIG. 6 is a side view of a hanger sold under the U.S. Pat. No. 4,509,713.

FIGS. 5*a* and 5*b* illustrate a second alternative embodiment which is essentially the same as the preferred embodiment except that the hook section 20*b* is offset so as not to be disposed in the same plane as the curved section 40. A picture or the like can be hung at point X.

While the invention has been particularly shown and described with reference to a preferred embodiment thereof, it will be understood by those skilled in the art that changes in form and detail may be made therein without departing form the spirit and the scope of the invention.

I claim:

1. A wall hanger for attaching to a wall in order to securely hold an object thereon consisting of, in combination, a single, continuous metal wire member, said wire member comprising a hook portion, said hook portion having a substantially "S" shaped configuration having a bottom hook member and a connected top curved member extending in front of the wall at an upwardly directed angle, a substantially linear portion, approximately ½ to 3/2 inches long, connected to said top curved member of said hook portion, a portion of said linear portion being part of said top curved member, and a curved portion connected to said linear portion; said curved portion having curved end portion means for gliding on the back surface of said wall to provide sufficient support to both flexing of said wall hanger and to enable said hook portion to hold said object; said hook portion having a substantially parabolic shaped portion having an open end, said open end of said parabolic shaped portion facing away from said wall and said hook portion and said linear portion being connected together at an acute angle of from about 15 degrees to about 45 degrees.

2. The wall hanger of claim 1 wherein said wire member having a thickness in the range of from about 1/32 to about 3/32 inches.

3. The wall hanger of claim 2 wherein said wire member having a thickness of about 1/16 inches.

4. The wall hanger of claim 1 wherein a bottom surface portion of said hook portion forms an acute angle with the front surface of said wall.

5. The wall hanger of claim 4 wherein said acute angle is in the range of from about 15 to about 45 degrees.

* * * * *